United States Patent [19]

Langenfeld

[11] Patent Number: 4,522,376

[45] Date of Patent: Jun. 11, 1985

[54] GAS FLUSHING INLET ARRANGEMENT IN A METALLURGICAL VESSEL AND METHOD OF OPERATION OF SUCH AN ARRANGEMENT

[75] Inventor: Wilhelm Langenfeld, Düsseldorf, Fed. Rep. of Germany

[73] Assignee: Didier-Werke A.G., Wiesbaden, Fed. Rep. of Germany

[21] Appl. No.: 610,419

[22] Filed: May 15, 1984

[30] Foreign Application Priority Data

May 20, 1983 [DE] Fed. Rep. of Germany ..... 3318422

[51] Int. Cl.[3] ..... C21B 7/16

[52] U.S. Cl. ..... 266/47; 75/59.1; 75/59.12

[58] Field of Search ..... 266/47; 75/60, 59

[56] References Cited

U.S. PATENT DOCUMENTS 4,222,553 9/1980 Edamoto ..... 75/60
4,296,921 10/1981 Hayashi ..... 75/60
4,331,471 5/1982 Langenfeld ..... 75/59
4,340,208 7/1982 Vayssiere ..... 75/60
4,378,106 3/1983 Hirschberg ..... 75/60

*Primary Examiner*—Peter D. Rosenberg
*Attorney, Agent, or Firm*—Nils H. Ljungman

[57] ABSTRACT

The invention relates to an arrangement of a blow pipe containing at least one gas permeable refractory plug. The blow pipe is disposed in the wall of a melt-containing vessel for the introduction of gases into the vessel. The blow pipe may be a metallic or ceramic pipe which passes through the vessel wall, and is longitudinally slidable in the vessel wall. Additional pieces of blow pipe in the form of pipe inserts can be added onto the blow pipe, which is in the wall vessel, to replenish the pipe insert material as it is consumed inside the vessel. The arrangement may include mechanical, pneumatic or hydraulic means to advance the pipe inserts into the vessel. The pipe inserts forming the blow pipe may be coated with a suitable lubricant. Alternatively, the pipe inserts may be surrounded by fire-bricks which may contain graphite.

21 Claims, 7 Drawing Figures

GAS FLUSHING INLET ARRANGEMENT IN A METALLURGICAL VESSEL AND METHOD OF OPERATION OF SUCH AN ARRANGEMENT

BACKGROUND OF THE INVENTION

1. Field of the Invention

The invention relates generally to metallurgical vessels containing molten metallic material, the vessels being of the type provided with a gas inlet at substantially the bottom-most portion thereof; the gas inlets provided are usually necessary to admit a particular gas, e.g., oxygen or air, to aid in the metallurgical process which the molten material in the vessel is required to undergo.

The invention teaches an arrangement of a gas inlet blow pipe containing at least one gas permeable refractory insert, in the wall of a melt-containing vessel, for the introduction of gases in the vessel. The gas permeable inserts are inserted in a metallic or ceramic gas inlet blow pipe which is disposed in a slidable fashion in the vessel wall.

2. Description of Prior Art

Before the advent of more recent technology, it was common practice to block or plug the gas inlet by means of a clay plug or a plug of ceramic material which is compatible with the encountered temperature in the metallurgical vessel, and the reaction which takes place therein. Whenever the need to open the gas inlet arose, the plugs were drilled open so as to enable the connection of say, a gas lance. More recently, to avoid the inconvenience and the delay caused by having to drill out the plug holes, metallic or ceramic blast pipes passing through the vessel wall have been used.

A prior art arrangement of a gas pipe inlet in a metallurgical vessel is known from German Patent Publication DE-OS No. 30 03 884. This known arrangement has certain disadvantages in that because the refractory inserts in the pipe are relatively hard, the task of boring out, for purposes of replacement of especially the innermost insert, which may have been rendered unusable after stoppage of gas flow, is time consuming. In addition to the wear of the refractory lining of the vessel wall in the area of the blast pipe, the front end of the gas inlet pipe containing the insert is also subject to wear. The maintenance of the refractory lining following wear usually comprises pouring in suitable materials by the so-called process of slag coating; in such process, additional measures must be taken to renew the operating condition of the gas inlet installation, since the blast pipe and the innermost insert undergo a gradual setback with respect to and because of the erosion of their original length. Hitherto, this problem could only be solved by boring out the worn front end of the gas flushing pipe and inserting a new gas flushing pipe insert.

The U.S. equivalent of the German Patent Publication DE-OS No. 30 03 884 is U.S. Pat. No. 4,331,471 to Langenfeld et al, issued on May 25, 1982. The Langenfeld patent is assigned to the same assignee as the present invention and is incorporated herein by reference.

OBJECT OF THE INVENTION

The object of the present invention is to provide a novel gas flushing inlet pipe arrangement so that the aforementioned problems are eliminated, and specially so that in case of wear of the front end of the installed gas flushing pipe, and in the case of the functional unsuitability of the innermost gas flushing insert because of hardened molten metal, the gas flushing inlet can quickly and easily be restored to operating condition without having to bore out the gas flushing pipe inserts.

DEFINITION OF THE INVENTION

The invention in its broad form resides in a gas flushing inlet arrangement in the wall of a melt-containing lined metallurgical vessel, for the introduction of gases into the vessel, said arrangement including at least one gas inlet pipe member passing through the vessel wall and containing at least one gas permeable insert, wherein said gas inlet pipe member is longitudinally slidable into the vessel wall.

In a preferred embodiment described herein, a pipe insert is longitudinally slidable into the vessel wall using mechanical means. In this way it is possible, following the wear of the refractory lining in the area of the gas flushing inlet installation (and prior to pouring in a suitable material or slag coating to compensate for the wear) to slide the gas inlet pipe insert in the direction of the vessel interior, at least as far as to bring the front end of the blast pipe to the level of the inner surface of the refractory lining and additionally for the compensation for wear by filling out or adding the slag coating. Specifically, following wear of the pipe inner end and prior to compensating for the worn refractory lining of the vessel wall, the blast pipe with inserts can be slid in the direction of the vessel interior until the front end projects out from the inner surface of the lining, after pouring of slag-coating to compensate for wear. This projecting part of the blast pipe with inserts is then quickly consumed by the melt during subsequent operation of the vessel, so that the innermost section of the insert, which is rendered useless by the penetration and solidification of molten metal upon stoppage of gas flow, is also removed; so that the boring out of the inserts is entirely unnecessary.

The longitudinal sliding action of the pipe in the vessel wall in this invention can easily be achieved, since the bricks of the vessel wall lining surrounding the pipe are expediently ceramic bricks of a type which would permit a sliding operation.

Special measures may also be taken, however, to assist the pipe to slide when necessary within the vessel wall. This can be achieved, for example, by ensuring that the bricks of the vessel wall lining, which surround the pipe, contain a fire resistant lubricant.

The lubricant should preferably be located in or on the portion of the brick immediately adjacent to the pipe, while the remaining portions of brick can be free of lubricant.

Furthermore, to facilitate the sliding of the pipe in the vessel wall, the outer surface of the pipe can be coated with a fire resistant lubricant.

The lubricant mentioned above can be graphite, for example.

Based on experience, it has been determined that the gas inlet pipe inserts may become subjected to carburization in use. Preferably, according to a modification of the inventive idea, the outer surface of the pipe is covered with an oxide ceramic or other carburization-inhibiting coating; otherwise, the carburization could deleteriously impair the desired sliding of the pipe in the vessel wall.

To maintain the desired sliding effect, according to a further modification of the invention, the bricks of the vessel wall lining adjacent to the pipe may contain graphite, in addition to the carburization-inhibiting-coating on the pipe insert.

The bricks of the vessel wall lining adjacent to the gas inlet pipe insert can be comprised mainly of graphite, for example, graphite fibers. In order to avoid an excessive overall length of the blast pipe and to keep the blast pipe operational at all times, the gas inlet pipe can advantageously be assembled from individual pipe sections of predetermined length, so that after sliding the pipe into the vessel interior, more and more additional pipe sections in the form of pipe inserts can be added on at the outside of the metallurgical vessel.

The predetermined length of the pipe sections should preferably be somewhat greater than the wear depth which is to be expected in the area of the wall around the pipe following a predetermined number of charges. This ensures that the inlet pipe consumption due to the predetermined number of charges does not exceed the length of one pipe section.

For precautionary reasons, the predetermined length of the pipe sections should preferably be approximately twice as large as the wear depth which is to be expected in the area around the pipe from a known number of charges.

The pipe sections in the form of pipe inserts can be advantageously made to form-fit or mate so as to be connected to each other in a gas-tight manner. In practice, this can be accomplished by bolting or otherwise assembling the pipe insert sections to one another.

Preferably, each pipe section has its own gas permeable refractory insert, so that the pipe sections can be bolted or assembled one by one as prefabricated units at the back end of the pipe.

Each gas permeable insert should preferably be somewhat shorter than the corresponding pipe section, so that compensating gas chambers in the form of spaces remain open between the end surfaces of adjacent inserts; such construction is particularly advantageous if gas permeability is made possible by means of longitudinal channels in the inserts rather than by entirely porous inserts. Thus with the compensating gas chambers, when the pipe sections are bolted together, it is not necessary to align the longitudinal channels of individual inserts.

Particular examples of the material for the gas permeable inserts may be found in the above-said prior art U.S. Pat. No. 4,331,471 which is incorporated herein by reference.

Expediently, a pushing device is attached to the portion of the pipe projecting out from the vessel wall, so that, when necessary, the pipe can be pushed into the interior of the vessel mechanically rather than manually.

A mechanical, hydraulic or pneumatic drive is suitable for such a pushing device.

The invention also comprises a method for operating an installation of the type described above, and is characterized in that the pipe with the inserts is pushed a predetermined distance into the interior of the metallurgical vessel following one or more charges.

The distance the pipe is pushed, that is, the feed length, advantageously corresponds approximately to the wear-depth resulting from the previous charge or charges, so that the front end of the blast pipe with the inserts is at least flush with the inside surface of the vessel wall after the wear is compensated for by pouring in lining material or slag coating.

The feed distance is preferably equal to or somewhat greater than the wear depth resulting from the previous charge or charges, plus the penetration depth of the melt in the innermost insert upon stoppage of gas flow. The blast pipe inserts 1, as mentioned previously, then project beyond the inside surface of the reconditioned vessel wall; any extension of the pipe inserts at the unusable front end, i.e., at the vessel interior, is flushed away by the new melt, thus restoring the pipe arrangement to its normal operating condition. Advantageously, the front end of the blast pipe inserts is flushed away simultaneously when the flushing gas pressure is being applied to the pipe arrangement, in order to avoid penetration of the new melt into the blast pipe.

Upon advancing the blast pipe insert into the interior of the vessel, additional pipe sections can be added to the back end of the pipe corresponding to the feed length, so that the pipe end projecting outside the vessel is always roughly the same length and can conveniently be gripped by the pushing device.

BRIEF DESCRIPTION OF THE DRAWINGS

Additional objectives, features, advantages and applications of the present invention will be apparent from the following description of preferred embodiments, to be read in conjunction with the accompanying drawings, wherein the figures show the following.

DESCRIPTION OF THE PREFERRED EMBODIMENTS

Figure 1:
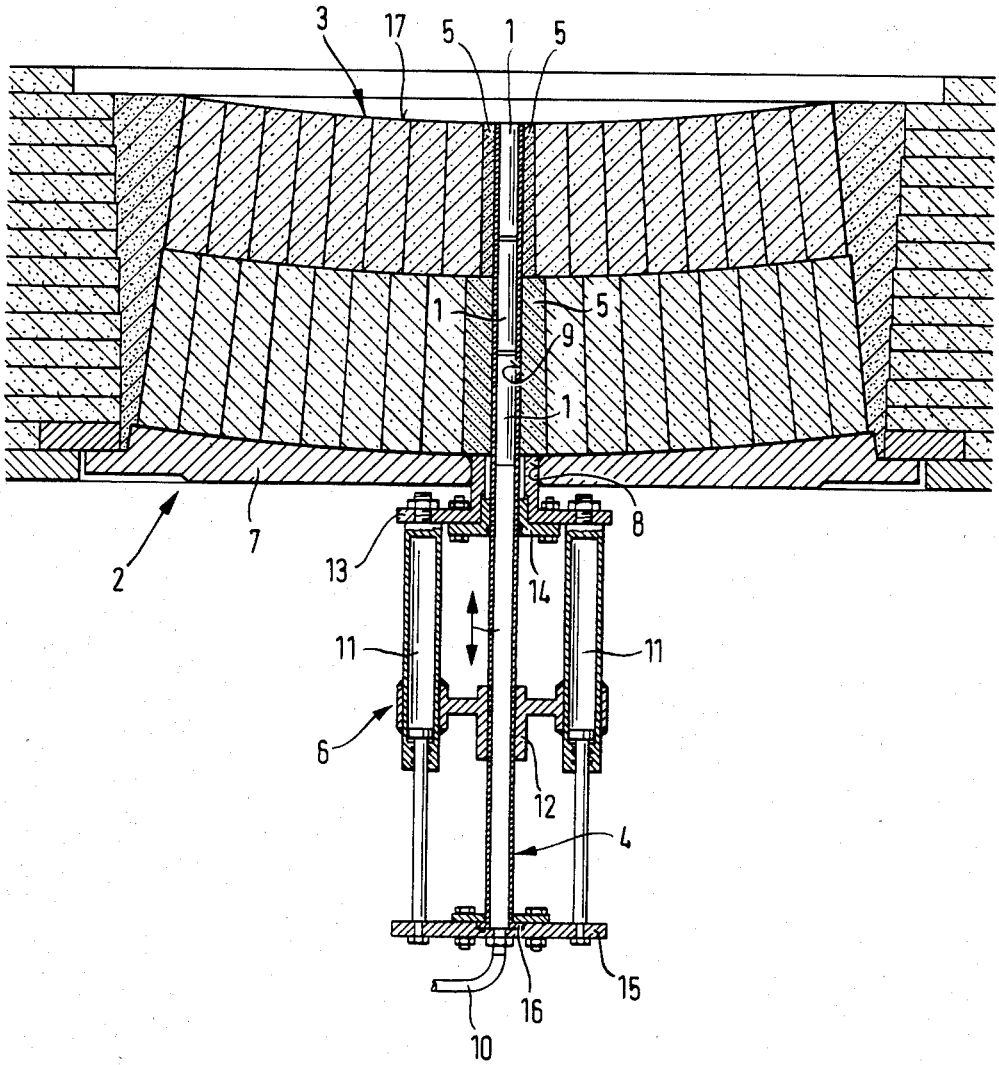
FIG. 1: a gas flushing arrangement corresponding to the invention for a reconditioned metallurgical vessel.

A preferred embodiment is described hereinafter with the aid of a drawing of FIG. 1 illustrating, as an example, a metallurgical converter having a wall 2, including a bottom having a lining 3 comprised of two layers of individual bricks, arranged on a bottom plate 7. The bottom plate 7 includes a region where gas is to be supplied to the interior of the vessel according to the invention; said region has a drilled opening 8, which continues as a bore hole 9 in the lining 3, said bore hole 9 having been formed in the lining 3, for example, by means of a boring machine. A metallic or ceramic pipe 4 is inserted into the bore hole 9. The pipe 4 arranged in the lining 3 contains one or more gas permeable inserts 1, either in the form of shaped brick or shaped pieces held in place with cement or mortar, or as bulk material, granular material or fibrous material which is poured in, pressed in or stamped in. Specific examples of the composition of the gas permeable inserts can be found in the U.S. Pat. No. 4,331,471, referred to hereinabove. After placing the inserts 1 in position, a gas supply line 10 can be connected to the outer end of the pipe 4.

The boundary surface between the pipe 4 and the bricks 5 adjacent to the pipe 4 is designed so that the pipe 4 can be made to slide in the longitudinal direction of the pipe 4 as indicated by the arrows in FIG. 1. The sliding of the pipe is accomplished expediently by means of a pushing device 6 having hydraulic cylinders 11. The device includes a guide 12 for admitting a gas into the end of the pipe projecting out from the wall 2; the device also includes a mounting support 13 at the bottom plate 7, a seal 14 to prevent gas leakage and a pressure or tension plate 15 onto which the back end of the blast pipe 4 is attached by means of a flange 16.

As illustrated, three inserts 1 are arranged in the blast pipe 4, of which the foremost insert, as well as the front end of the blast pipe 4, are flush with the inside surface 17 of the lining 3.

Figure 2:
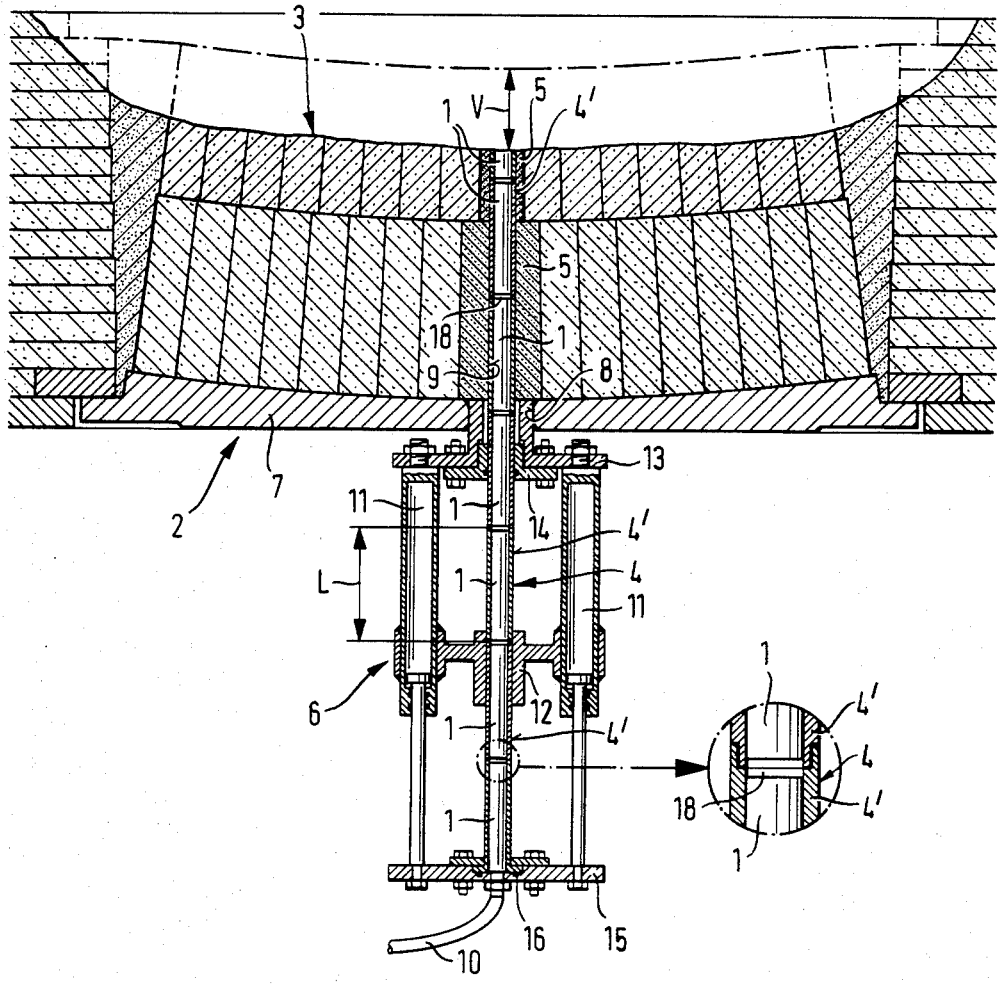
FIG. 2: the arrangement according to FIG. 1, following wear after a predetermined number of charges.

FIG. 2 shows how the lining 3, including the front end of the blast pipe 4 and the front end of the innermost insert 1, is consumed as the result of one or more metallic charges being processed by the metallurgical converter. In the embodiment illustrated in FIG. 2, the blast pipe 4 is comprised of individual pipe sections 4' of predetermined length "L". Each pipe section 4' has its own insert 1, which is slightly shorter than the corresponding pipe section 4', so that gas compensating chambers 18 remain open between the end surfaces of the adjacent inserts 1. The pipe sections 4' can be assembled end-to-end or bolted to one another. As illustrated, the wear depth "V" is smaller than the predetermined length "L" of the foremost pipe section 4'.

Figure 3:
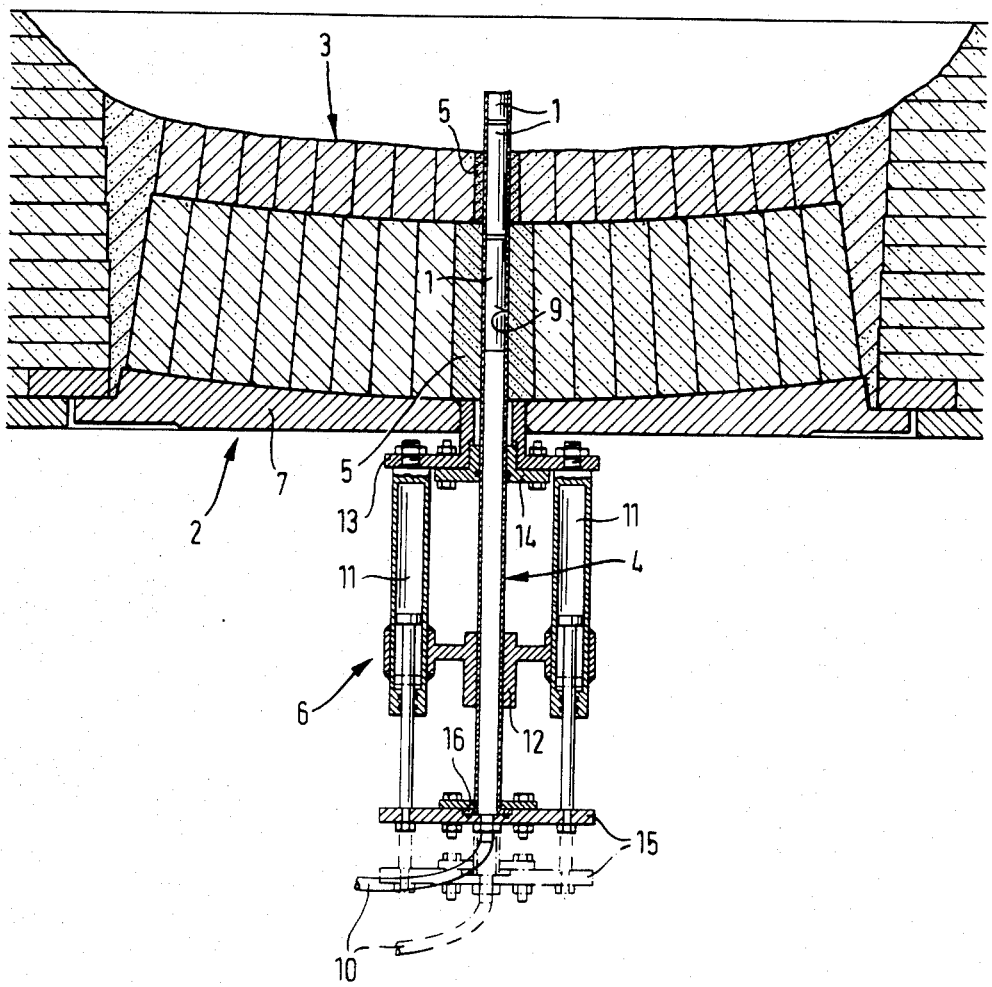
FIG. 3: the arrangement according to FIG. 2, after advancing the blast pipe prior to repairing the vessel bottom.
Figure 4:
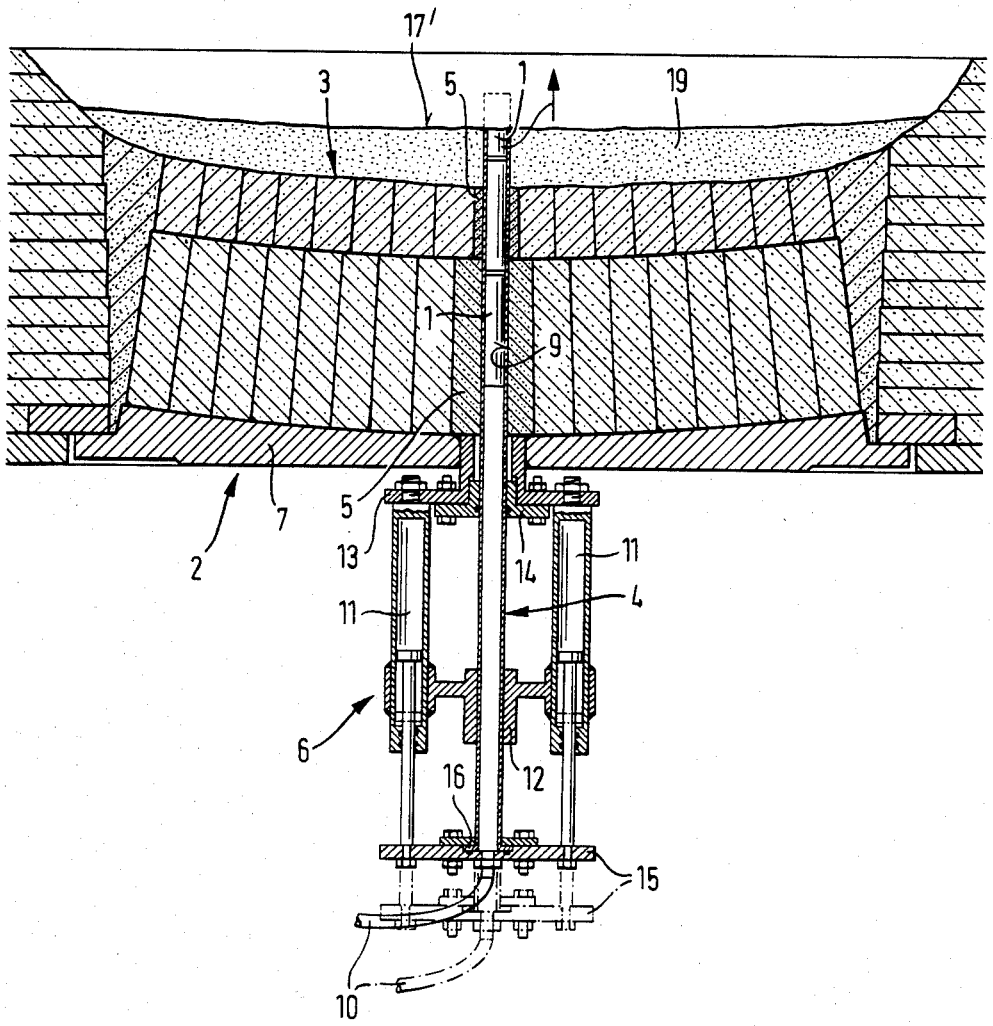
FIG. 4: the arrangement according to FIG. 3 after repairing the vessel bottom with refractory material.

As diagrammatically illustrated in FIG. 3, the continuous pipe 4 is advanced by means of the pushing device 6 in preparation for the reconditioning of the lining 3, so that, as shown in FIG. 4, the front end of the pipe 4 and the innermost insert 1 are flush with the inside surface 17' of the refractory material 19 poured in for the reconditioning of the metallurgical converter. The blast pipe 4 with inserts 1 can initially be pushed so far into the interior of the vessel that the front end projects beyond the new introduced refractory material 19. This projecting portion is then consumed by the melt, whereby the innermost section of the innermost insert 1, which would be rendered useless by the solidification of molten metal, is thus automatically removed. Therefore, boring out will no longer be necessary.

Figure 5:
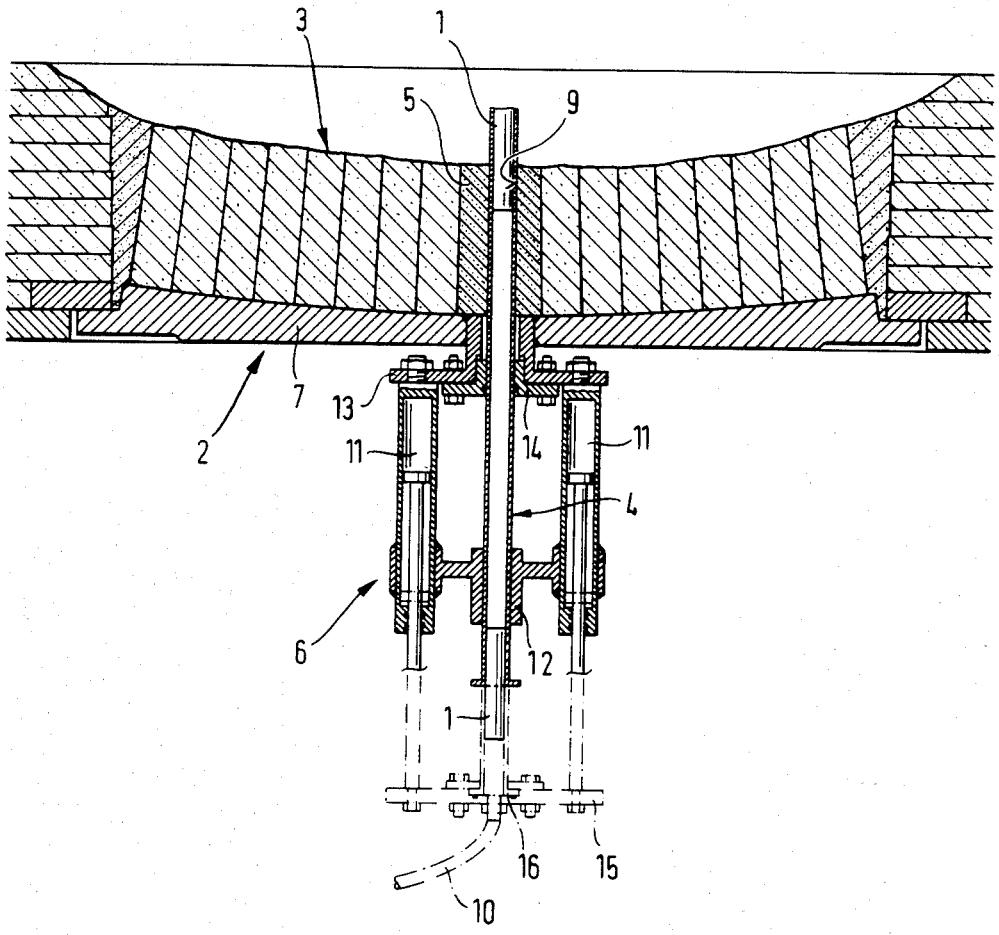
FIG. 5: wear of the refractory lining after additional charges, subsequent addition of refractory inserts in the blast pipe and advancing the blast pipe prior to repairing the vessel bottom.
Figure 6:
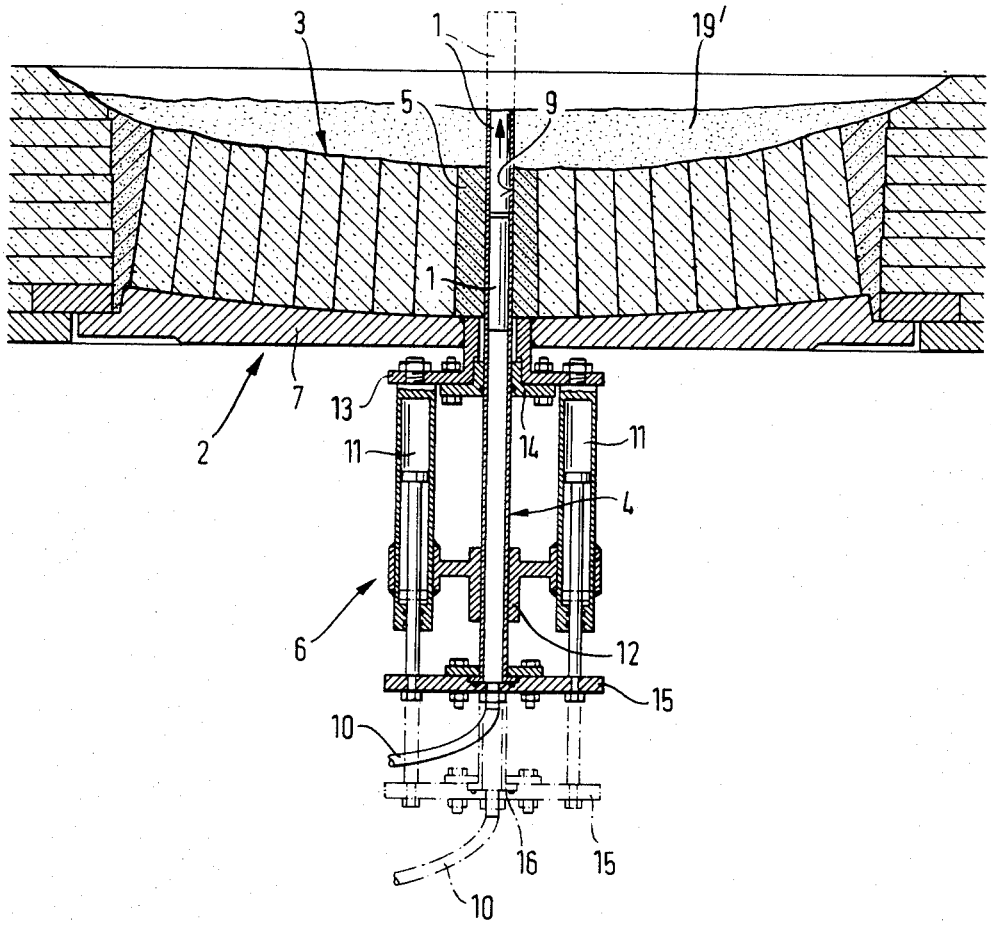
FIG. 6: the arrangement according to FIG. 5 after repairing the vessel bottom with refractory material.

FIG. 5. shows the arrangement after additional wear of the lining 3 due to subsequent, additional charges, and also the further advancing of the blast pipe 4 may be done in preparation for the next reconditioning or replenishing, as illustrated in FIG. 6, by the pouring in and deposition of additional refractory material 19'.

Figure 7:
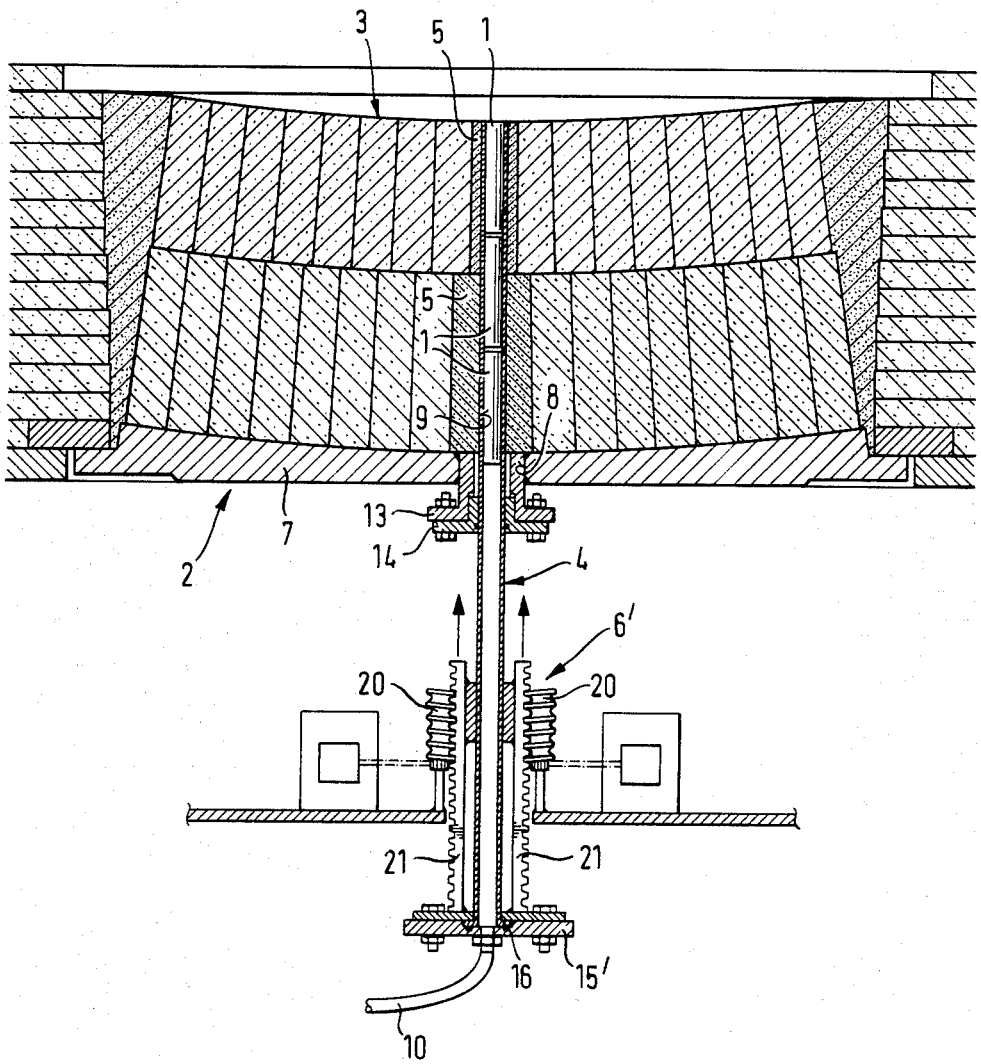
FIG. 7: another embodiment of the inventive gas flushing arrangement with a mechanical pushing device.

As illustrated in FIG. 7, the pushing device 6' is not hydraulic, but rather mechanical, in that a worm gear 20 engages a rack 21 which is connected to a pressure plate 15'. The plate 15' interacts with the back end portion of the blast pipe 4 in the same manner as the pressure plate 15 illustrated in FIG. 1.

The foregoing are only exemplary embodiments of the invention; the invention is not to be taken as limited to all the details thereof, since modifications and variations thereof may be made without departing from the spirit or scope of the invention.

What is claimed is:

1. A gas flushing inlet arrangement in the wall of a melt-containing lined metallurgical vessel for the introduction of gases into the vessel, said wall having an exterior portion and an inner portion, said arrangement including at least one gas pipe inlet member passing through said vessel wall and containing at least one gas permeable insert, wherein said arrangement includes means for selectively advancing said gas pipe inlet member slidably with respect to a longitudinal axis of said pipe insert into said vessel wall, said advancing means being mounted adjacent said exterior portion of said wall.

2. The arrangement according to claim 1, wherein the lining of the vessel wall comprises refractory bricks surrounding said pipe inlet member in a fluid-tight manner, at least some of said refractory bricks carrying a lubricant.

3. The arrangement according to claim 2, wherein said lubricant is carried by said refractory bricks adjacent to said pipe insert.

4. The arrangement according to claim 1 wherein an outer surface of said pipe inlet member includes a coating of a refractory lubricant.

5. The arrangement according to claim 2, wherein said lubricant comprises graphite.

6. The arrangement according to claim 1, wherein an outer surface of said pipe inlet member includes a covering of a carburization-inhibiting coating.

7. The arrangement according to claim 2, wherein said refractory bricks in the lining of the vessel wall surrounding said pipe inlet member contain graphite.

8. The arrangement according to claim 1, wherein said pipe inlet member comprises individual pipe sections of predetermined length.

9. The arrangement according to claim 8, wherein said predetermined length is somewhat larger than a known liningwear depth to be expected in the vessel wall area around said pipe inlet member after a predetermined number of charges.

10. The arrangement according to claim 9, wherein said predetermined length is approximately twice as large as the wear depth to be expected in the wall area around the pipe after a predetermined number of charges in the metallurgical vessel.

11. The arrangement according to claim 8, wherein said pipe sections include means which can be connected in a gas-tight and form-fit manner.

12. The arrangement according to claim 8, wherein said pipe sections include means that can be plugged into one another to assemble said pipe inlet member.

13. The arrangement according to claim 8, wherein each said pipe section includes a gas permeable refractory insert therein.

14. The arrangement according to claim 13, wherein each said gas permeable insert is somewhat shorter than the corresponding pipe section.

15. The arrangement according to claim 1, including a pipe pushing device disposed to push a portion of said pipe inlet member which projects outside the vessel wall.

16. The arrangement according to claim 15, wherein said pushing device has an operating means selected from the group consisting of mechanical, hydraulic and pneumatic mechanisms.

17. A method of operating a gas-flushing inlet in a melt-containing metallurgical vessel with a lining wherein said gas flushing inlet comprises a pipe insert passing through said metallurgical vessel substantially at the vessel bottom, a gas flow being admitted into said vessel through said pipe insert, and also replenishing said pipe insert, comprising the steps of:

ascertaining an extent of a depth of lining wear inside said metallurgical vessel, during usage in an area of said pipe insert, for a predetermined number of charge operations of said metallurgical vessel;

selectively feeding said pipe insert into said metallurgical vessel after each completion of said predetermined number of charge operations; and controlling said selective feeding in terms of a feed-distance such that said feeding, after each said completion of said predetermined number of charge operations, is at least equal to said extent of said depth of lining wear.

18. The method according to claim 17, wherein said pipe insert comprises a plurality of axially assembled pipe insert lengths, and wherein said feed-distance is at least equal to said wear depth of the previous charge or charges plus a penetration depth of the melt in an innermost pipe insert upon stoppage of gas flow.

19. The method according to claim 17, including the method step of adding relatively shorter lengths of pipe insert to said pipe insert outside of said metallurgical vessel as necessary.

20. The method according to claim 19, including the method step of feeding said pipe insert by one of the methods consisting of hydraulic and pneumatic operations.

21. A lined melt-containing metallurgical vessel having a wall;

a gas flushing inlet arrangement in said wall of said metallurgical vessel, said inlet arrangement for the introduction of gases into said vessel, said arrangement comprising:

a gas pipe inlet member passing through said wall of said vessel and containing at least one gas permeable insert;

refractory material, surrounding said gas pipe inlet member, and in a liquid-tight relationship with said pipe insert;

a lubricant disposed between said gas pipe inlet member and said refractory material; and said gas flushing inlet, said arrangement including additional pipes similar to said gas pipe inlet member for being added to a length of said pipe inlet member outside of said metallurgical vessel, as and when said pipe inlet member gets consumed in use by the melt contained inside the metallurgical vessel.

* * * * *